US006634152B1

(12) United States Patent
Pilkinton

(10) Patent No.: US 6,634,152 B1
(45) Date of Patent: Oct. 21, 2003

(54) COLLAPSIBLE METAL TRUSS

(76) Inventor: David Pilkinton, 28625 Grayling Ave., Farmington Hills, MI (US) 48336

( * ) Notice: Subject to any disclaimer, the term of this patent is extended or adjusted under 35 U.S.C. 154(b) by 32 days.

(21) Appl. No.: 10/075,061

(22) Filed: Feb. 13, 2002

(51) Int. Cl.[7] ..... E04B 1/32
(52) U.S. Cl. ..... 52/641; 52/645; 52/90.1
(58) Field of Search ..... 52/71, 64, 66, 52/645, 634, 635, 636, 639, 640, 641, 90.1

(56) References Cited

U.S. PATENT DOCUMENTS 3,760,550 A 9/1973 Mueller et al.
3,785,108 A 1/1974 Satchell
4,435,940 A 3/1984 Davenport et al.
5,463,837 A 11/1995 Dry
5,542,227 A 8/1996 Frayne
5,819,492 A 10/1998 Konicek
6,073,414 A 6/2000 Garris et al.

*Primary Examiner*—Carl D. Friedman
*Assistant Examiner*—Naoko Slack
(74) *Attorney, Agent, or Firm*—Young & Basile P.C.

(57) ABSTRACT

Two embodiments of a collapsible metal roof truss are disclosed. Both embodiments are made up jackknife foldable left and right heel sections, a jackknife foldable peak section and a center bottom chord. In the flat ceiling embodiment the center bottom chord can be solid. In the second cathedral ceiling embodiment the center bottom chord is split into two pivotally interconnected sections and a vertical web leg is added. The truss can be assembled in a variety of shapes and sizes and configurations and is easily collapsed after partial prefabrication for convenient shipping.

7 Claims, 4 Drawing Sheets

COLLAPSIBLE METAL TRUSS

FIELD OF THE INVENTION

This invention relates to collapsible metal trusses and more particularly to a truss which can be erected in a number of different sizes and configurations and which, prior to erection and assembly, comprises at least two jackknifed sections which can be conveniently boxed in a folded state for shipment.

BACKGROUND OF THE INVENTION

Roof trusses for commercial and residential buildings are typically prefabricated using wooden beams and metal joiner plates. Such prefabricated structures are large and heavy and must be shipped from the factory to the building site in small numbers on a large truck.

The prior art shows efforts to design collapsible building trusses made of metal components which can be telescoped and folded so as to reduce the size and, presumably, the weight of the structure to be shipped to the building site. An example is shown in Mueller et. al. U.S. Pat. No. 3,760,550 issued Sep. 25, 1973, The metal truss structure disclosed in this United States Patent can be collapsed to a shipping length of 28 feet and, according to the patent, can be erected at the building site into a roof truss having a predetermined pitch.

SUMMARY OF THE INVENTION

The present invention provides a collapsible metal building truss made up of a number of preassembled jackknife sections which are easily and conveniently shipped in a folded state and which can be opened and assembled at the building site to create a truss of nearly any desired configuration and size; i.e., the resulting truss can be symmetrical or asymmetrical, of any desired width within a predetermined range, of any desired height within a predetermined range, and of any desired pitch consistent with the selected height and width. In a specific embodiment hereinafter disclosed, the truss can also be erected in both flat and cathedral ceiling configurations.

Because the truss of the present invention is made up of preassembled and jackknife folded sections, the boxed and shipped size is far smaller than that of the Mueller et. al. truss. This shipping size advantage, in combination with the size and configuration flexibility described above, is believed to represent a substantial advance in the collapsible truss art.

As hereinafter described with reference to two specific but illustrative embodiments, the jackknife sections are made up of partial chords and partial webs, the chords typically having U-shaped cross sections and the webs typically having H-shaped cross sections. The sizes of the chord sections vary between layer "outer" sections and slightly smaller "inner" sections. The web sections are sized to fit within the chord sections. The cross-sections of the chords are preferably U-shaped while the web sections are preferably H-shaped.

BRIEF DESCRIPTION OF THE DRAWINGS

The description herein makes reference to the accompanying drawings wherein like reference numerals refer to like parts throughout the several views, and wherein.

DETAILED DESCRIPTION OF THE ILLUSTRATIVE EMBODIMENTS

Figure 1:
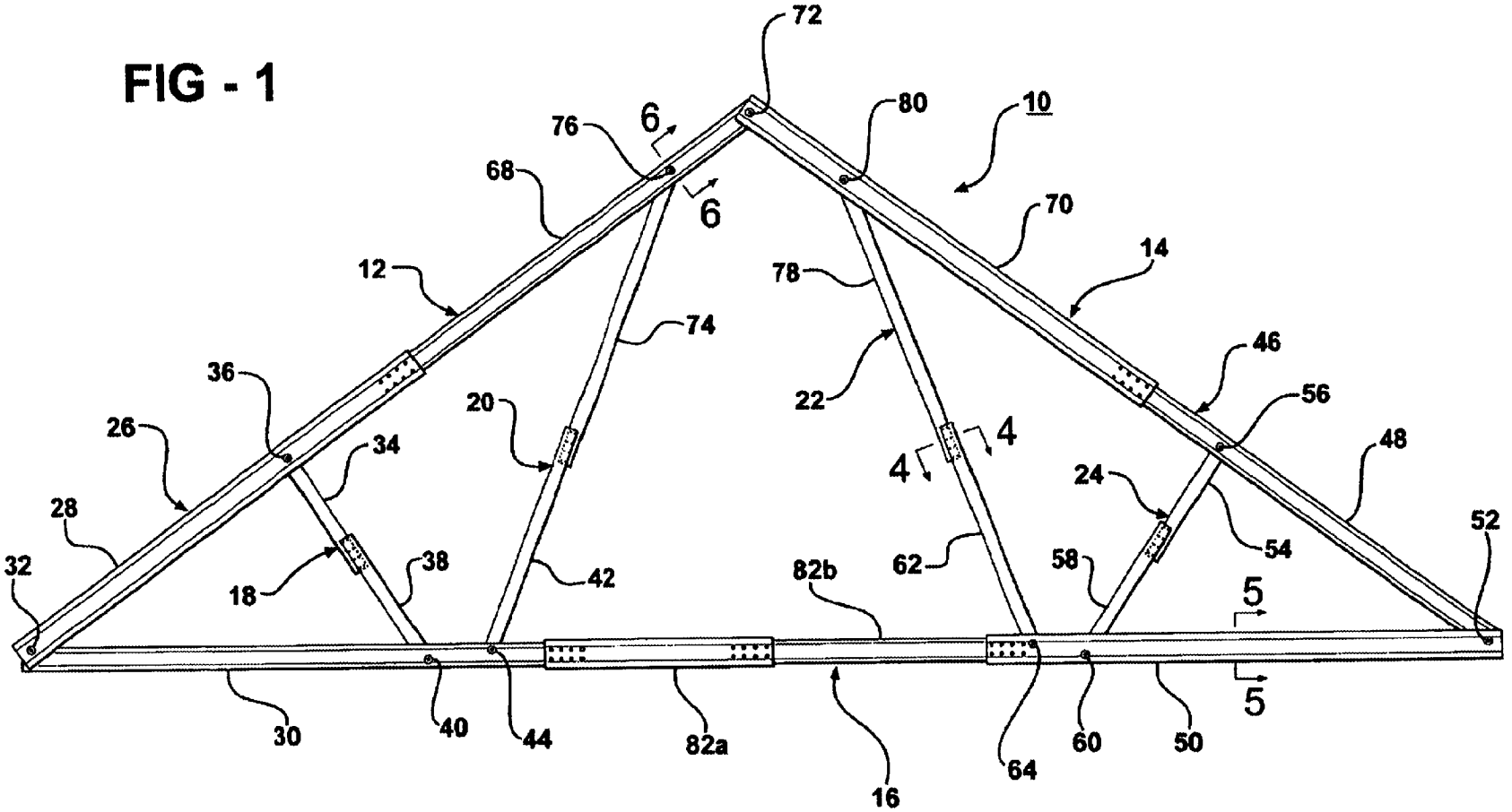
FIG. 1 is a plan view of a fully assembled truss according to one embodiment of the invention.

Referring now to FIG. 1 a fully erected truss 10 providing a conventional flat interior ceiling design is shown to comprise a left top chord 12, a right top chord 14 and a bottom chord 16. The truss further comprises a W-shaped web made up of legs 18, 20, 22 and 24. The chords and legs of the truss 10 are pivotally interconnected at the three corners; i.e., at the left and rights ends and at the peak, and are rigidly and permanently screwed or otherwise fastened together at overlapping areas as hereinafter described. In addition the outside ends of the web legs are pivotally connected to the chords as also hereinafter described in detail.

Figure 2:
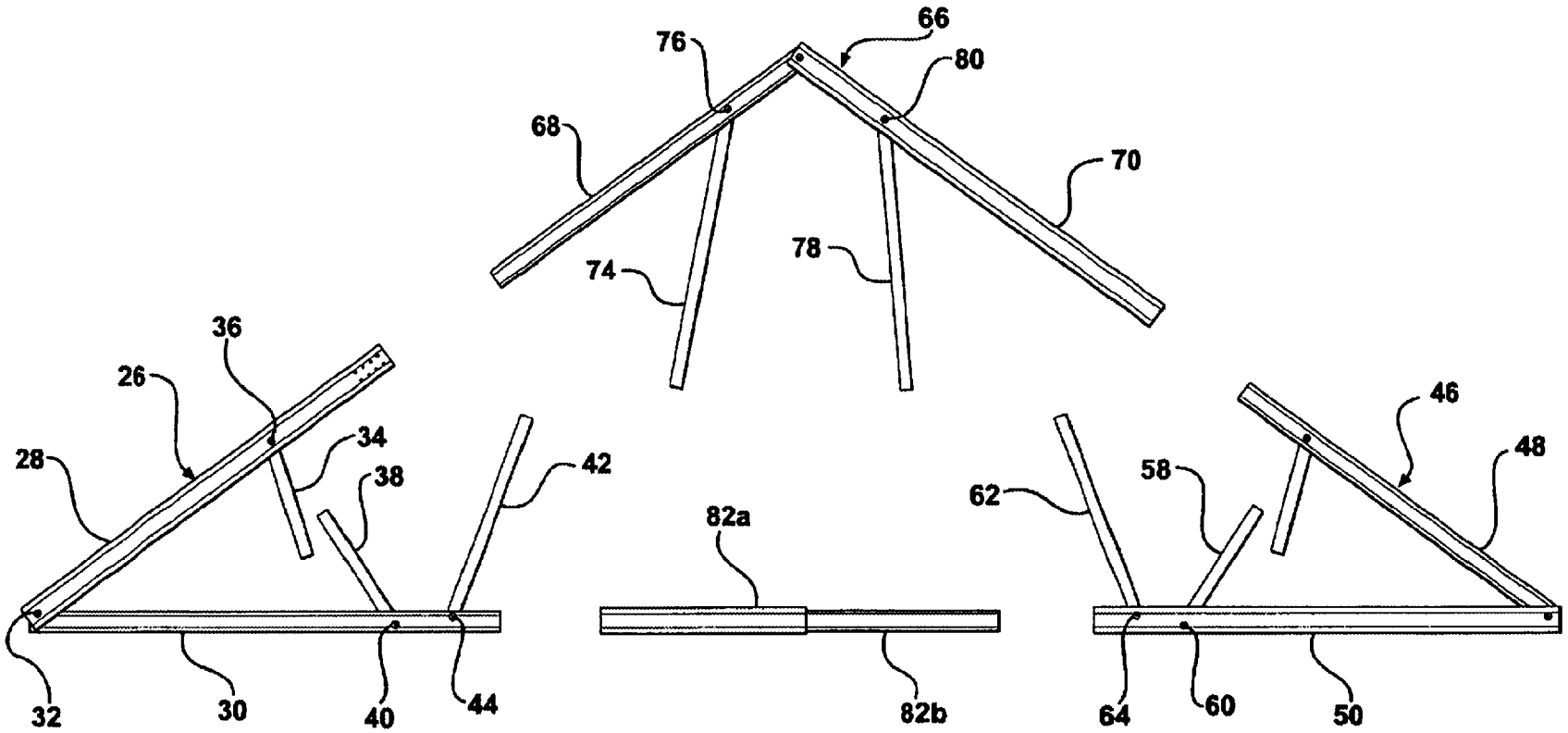
FIG. 2 is an exploded view of the truss of FIG. 1 showing the various jackknife type sections.

Referring now to FIGS. 1 and 2, the truss 10 is shown to comprise a left heel section 26 of foldable jackknife configuration comprising a partial top chord 28 and a partial bottom chord 30, the partial chord sections 28 and 30 being pivotally interconnected at 32 to form the left corner of the truss 10. A partial web leg 34 is pivotally connected to the partial top chord 28 at 36, the pivot point being located approximately 2½ feet from the upper right end of the partial top chord 26 as shown in FIG. 2. A partial web leg 38 is pivotally connected to the partial bottom chord 30 at pivot 40. A partial web leg 42 is pivotally connected to the partial bottom chord 30 at 44. The spacing between the pivot point 44 and the right end of the partial chord 30 as shown in FIG. 2 is approximately 18 inches and the spacing between the pivots 40 and 44 is approximately 8–12 inches.

Figure 4:
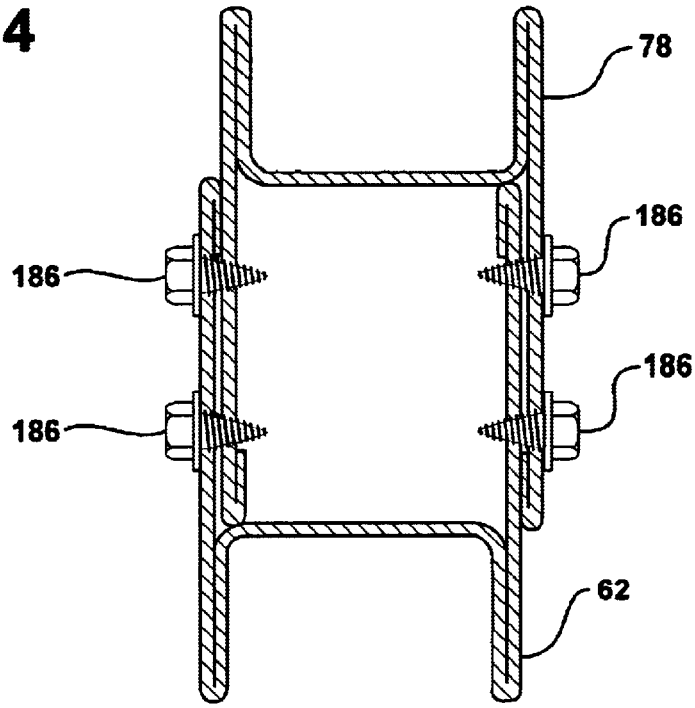
FIG. 4 is a cross-section of an area in FIG. 1 where two web members are joined.
Figure 5:
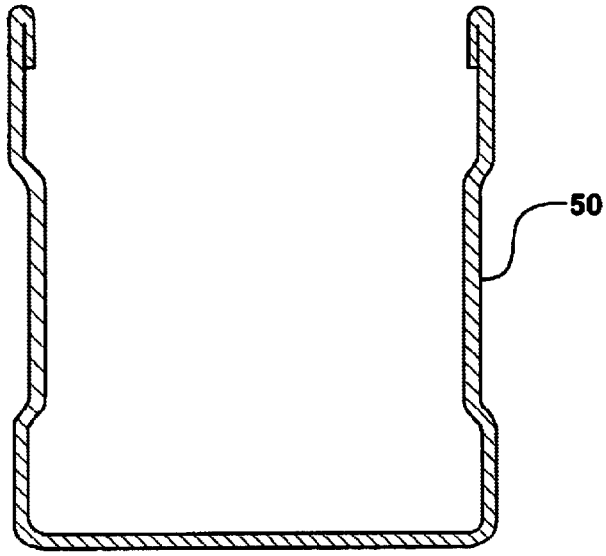
FIG. 5 is a typical cross-section of a chord component in both of the embodiment of FIGS. 1 and 3.

It will be noted from FIG. 5 that the cross-sections of the chord sections 28 and 30 are U-shaped and that the closed portion of each section is on the outside. This provides an interior volume for the web sections 34, 38 and 42 when the heel section 26 is folded. It will also be noted that the width of the inner chord section 30 is 1/16 smaller than the width of the outer chord section 28 to permit the two chord sections to slide into one another when joined as shown in FIG. 1. All of the chord sections in the truss 10 are either large "outside" sections or small "inside" sections to fit together in the desired manner. The web sections, however, are all the same in cross-sectional dimensions and fit together as shown in FIG. 4.

The truss 10 of FIG. 1 further comprises a right side heel section 46 which is reversely similar to the left side heel section 26 with the exception that the top chord section 48 is an inside section. More specifically, the right side heel section 46 comprises partial top chord 48 and partial bottom chord 50 pivotally interconnected at 52 to form the right corner of the truss. A partial web leg 54 is pivotally connected to the partial top chord 48 at 56. A partial web leg 58 is pivotally connected to the partial bottom chord 50 at 60. A partial web leg 62 is pivotally connected to the partial bottom chord 50 at 64. The spacing between the inside or left end of the partial bottom chord 50 and the pivot point 60 and 64 is essentially as was described with reference to the left heel section 26. Pivot 64 is higher than pivot 60 to allow section 62 to lie on top of section 58 when folded.

It can be seen from the description provided thus far that the heel sections 26 and 46 are essentially of a jackknife configuration wherein the components thereof can be folded inwardly like the components of a jackknife to provide an essentially flat linear type combination of components which are easily placed in a sturdy box with shipping straps or the like along with other components for convenient shipping. It can also be seen that because the pivotal interconnection such as 32, 36, 40 and 44 are prefabricated, the components are easily opened up and arranged in the desired configuration when the time comes to erect and assemble the truss 10.

Continuing with the description of the apparatus shown in FIG. 1 and FIG. 2, the truss 10 further comprises a peak section 66 which is also made up of preassembled metal components in a foldable or collapsible jackknife configuration. More specifically, the peak section 66 comprises a left side partial top chord 68 and a right side partial top chord 70, the two partial top chords being pivotally interconnected at 72. A partial web leg 74 is pivotally connected to the partial top chord 68 at 76. A partial web leg 78 is pivotally connected to the partial top chord 70 at 80. Like the preassembled heel sections, the peak section 66 can be folded into a nearly flat linear configuration or opened up into essentially the configuration shown in FIG. 2.

The truss 10 is completed by way of a two-part bottom chord center section 82*a*, 82*b* which can be on the order of 8–14 feet in length.

All of the components shown in FIG. 2 can be folded and placed in a single sturdy box for shipment. As described above the overall length of the box can be reduced to a desired minimum length such as 8 feet and still provide a fully assembled truss having an overall width of 28 feet or more. Of course sizes are all subject to the selection of the designer and may be greater or lesser than the number given herein.

As also shown in FIGS. 1 and 2, the cross-section of the chord components 28, 30, 48, 50, 68, 70 and 82 is U-shaped and the outer chord components are typically 1/16 of an inch or more greater in width than the inner chord and web components such that the chord components slidingly telescope into one another to assemble the truss 10. The cross-section of the inside and outside web legs is H-shaped so that they can easily fold on top of one another as well as telescope into one another to assemble the truss 10 as shown in FIG. 4.

The pivotal interconnections between the web sections and the chord sections are positioned so that the web sections can be fully folded into their corresponding chord sections. The web pivot points 40 and 44 must be offset so that web leg 38 can be positioned deeper into the "U" shaped channel of the bottom chord section 30 and web leg 42 having a higher pivot point can lie on top of web leg 38 and still be folded into "U" shaped channel bottom chord 30. The same method of web pivot locations applies to the right heel section as web leg 58 is pivoted at a lower position relative to web leg 62, so that web leg 62 can lie flat on top of web leg 58 when folded into the "U" shaped channel of bottom chord 50.

The pivot point between the web sections and chord sections must be within one foot from the end of the chord section so that the chord section can be telescopically attached to the adjoining chord section. For example, the left heel section 26 has three web members pivotally pre-attached. Web leg 34 is pivotally attached to chord section 28 at pivot 36. Pivot position 36 must be within one foot from the end of chord section 26. Pivot connection 44 must also be within one foot from the end of bottom chord section 30. Likewise, in the right heel section, web leg 54 at pivot 56 must be within one foot from the end of top chord section 46 and pivot 64 must be within one foot from the end of bottom chord section 50.

The four sections, left heel section, right heel section, peak section and the center bottom chord section are mechanically attached to each other via metal screws, bolts or other devices known in the art to permanently join them together. They may even be welded after layout and assembly. In the illustrations, the telescopic interconnections are made, for example, eight sheet metal screws using pre-drilled holes in the interconnected pieces. The left heel section 26 is telescopically attached to the peak section 66 by mechanically attaching top chord 28 to top chord 68. The right heel section is telescopically attached to the peak section by mechanically attaching top chord 46 to top chord 70. The two heel sections are connected in the same manner to the center bottom chord section 16.

The truss can be made of a number of different materials including steel or aluminum. The choice of material is a function of the required strength as determined by a design engineer. Web sections 34, 38, 42, 74, 78, 62, 54 and 58 can be tubular or of many other available sections. In addition, the truss is not required to be symmetrical. The roof peak 66 does not necessarily have to be directly over the center of bottom chord 16. The peak can be to one side or the other, in which case the resulting pitch factors of the left and right top chords are different. This asymmetrical shape can be accomplished by varying the telescoping connections and rotating connections of the members in each of the four sections.

Figure 3:
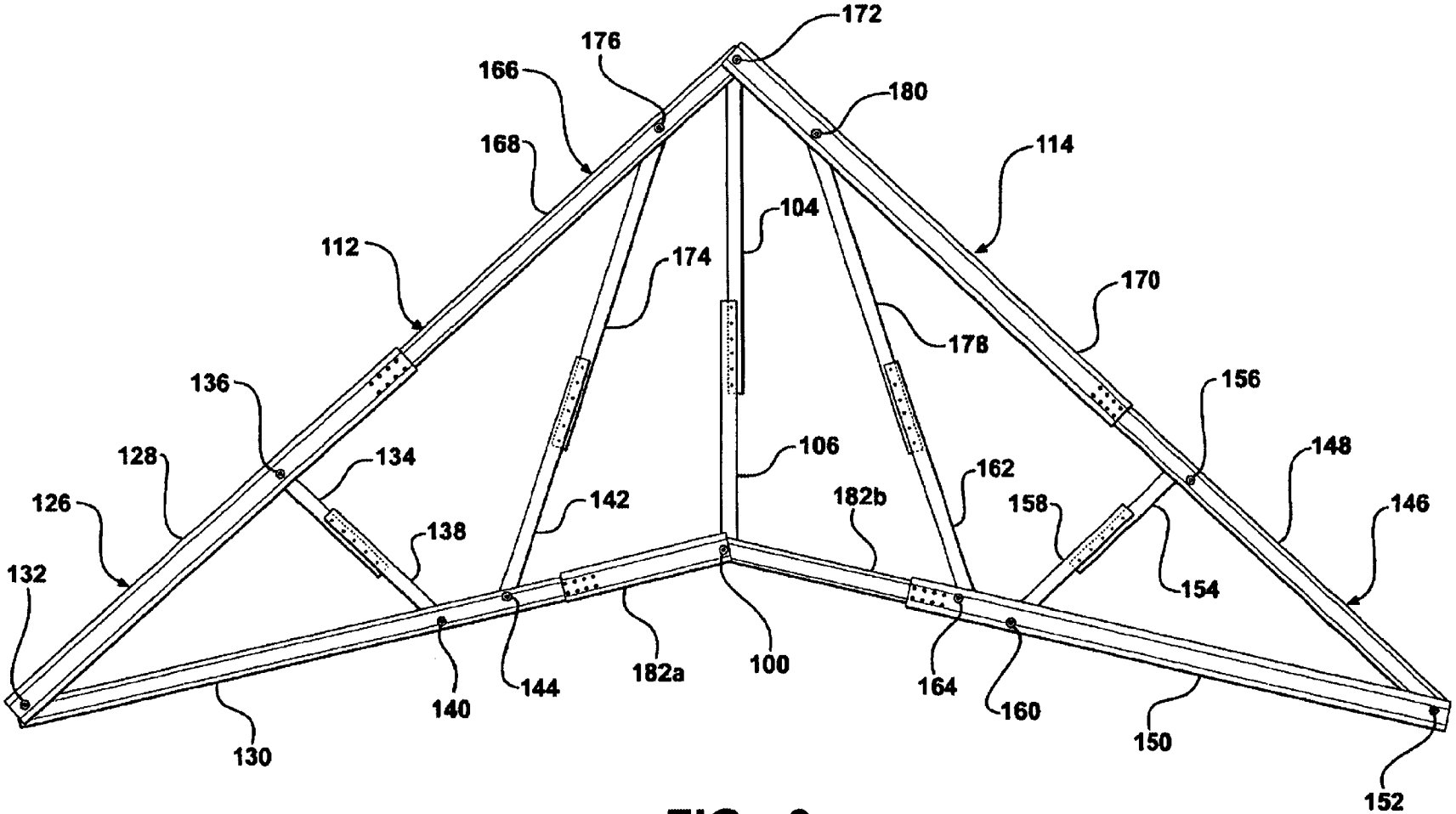
FIG. 3 is a plan view of an assembled truss according to a second embodiment of the invention.

FIG. 3 shows a cathedral truss as a second preferred embodiment. The cathedral truss is essentially made of the same components as the flat ceiling truss of FIG. 1 and like components of FIG. 3 are given the same reference numbers with the addition of a prefix "1." For example the part with reference number 26 in FIG. 1 corresponds to the part with number 126 in FIG. 3. In brief, the FIG. 3 embodiment comprises a left heel section 126, a right heel section 146 and a peak section 166. The center bottom chord has two sections 182*a* and 182*b* pivotally connected at 100 to form a ceiling peak. The other ends of the center bottom chord are telescopically connected to the bottom chord sections 130 and 150 of the left and right heel sections in the same manner as taught in the first preferred embodiment. In addition, a two part center web section comprising segments 104 and 106, is connected pivotally at peak 172 and to the pivot point 100 of the center bottom chord sections 82*a* and 82*b*. Similar to the FIG. 1 truss, the cathedral truss can be symmetrical or asymmetrical for both the roof and ceiling. The roof peak or the ceiling peak can be moved from the center of the truss to one side or the other by telescoping and pivoting the various interconnected members.

FIG. 4 is taken through the section line 4—4 in FIG. 1 and shows how the web section 62 and 78 are overlapped and joined together with screws 186.

FIG. 5 shows a cross-section through section line 5—5 of FIG. 1 for the chord sections 50. The cross-section is generally a "U" shape so the web sections can be folded into the "U" section of the corresponding chords. The chord sections are alternately larger by 1/16 inch so that each can be slidably and telescopically attached to the adjoining chord member.

Figure 6:
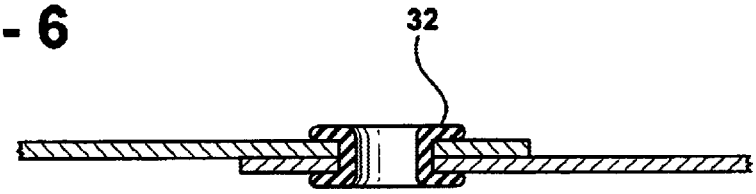
FIG. 6 is a detail of a pivotal connection between two chord sections or between a web section and a chord section.

FIG. 6 shows a stamped hinge pivot 32 for use at each of the chord-to-chord and web-to-chord pivot connections. The hinge is attached to the pivot locations so that both pivotal members are preassembled in a compact manner, but can be unfolded and connected to their mating section quickly and easily. It will be appreciated that two such pivots are used at each pivotal connection.

As indicated above, the end user receives the truss, whether it be the FIG. 1 embodiment or the FIG. 3 embodiment, in a shipping container with the heel and peak sections folded. The user assembles the truss at the location he finds most convenient. For example, the user may lay out a template for the assembled truss on a floor or other large flat work surface. Careful measurements are taken between the corners to place all of the components in the correct positions. A template may be marked with stakes, chalk, paint or tape to expedite the assembly or multiple trusses of the same size and shape. Once the components are properly laid out, holes are drilled and screws inserted to complete the assembly. The chords are preferably joined before the webs.

While the invention has been described in connection with what is presently considered to be the most practical and preferred embodiment, it is to be understood that the invention is not to be limited to the disclosed embodiments. But on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A collapsible metal truss which, when erected, exhibits a base chord, two top chords which intersect to form a peak and a W-shaped web having two inside web legs and two outside web legs, said truss comprising:

a pair of heel sections each including the jackknife foldable combination of partial top and bottom chords each having first and second ends; the first ends of each of said chords being pivotally connected to form a truss corner, a first partial outside web leg pivotally connected to the partial top chord near the second end, a second partial outside web pivotally connected to the partial bottom chord near the second end and a first partial inside web leg pivotally interconnected to the bottom partial chord near the second end;

a peak section comprising the jackknife foldable combination of left and right partial top chords each having first and second ends, the first ends of said chords being pivotally interconnected to form a peak, the second partial inside webs pivotally connected to the left and right partial top chord respectively; the partial top chords being telescopically slidably joinable;

the partial inside web legs being telescopically slidably joinable; the partial outside web legs being telescopically slidably joinable; and a bottom center chord which is telescopically slidably joinable to and between the partial bottom chords of the heel sections.

2. A collapsible metal truss as defined in claim 1 wherein the chord sections are U-shaped in cross-section and the web sections are H-shaped in cross-section.

3. A collapsible metal truss as defined in claim 1 wherein the bottom chord center section is non-pivotal.

4. A collapsible metal truss as defined in claim 1 wherein the bottom chord center section is made up of two pivotally interconnected chord legs.

5. A collapsible metal truss which, when erected, exhibits a base chord, two top chords which intersect to form a peak and a W-shaped web having two inside web legs and two outside web legs, said truss comprising:

a pair of heel sections each including the jackknife foldable combination of partial top and bottom chords each having first and second ends; the first ends of each of said chords being pivotally connected to form a truss corner, a first partial outside web leg pivotally connected to the partial top chord near the second end, a second partial outside web pivotally connected to the partial bottom chord near the second end and a first partial inside web leg pivotally interconnected to the bottom partial chord near the second end;

a peak section comprising the jackknife foldable combination of left and right partial top chords each having first and second ends, the first ends of said chords being pivotally interconnected to form a peak, the second partial inside webs pivotally connected to the left and right partial top chord respectively; the partial top chords being telescopically slidably joinable;

the partial inside web legs being telescopically slidably joinable; the partial outside web legs being telescopically slidably joinable;

a bottom center chord section having two members pivotally attached at the center and is telescopically slidably joinable to the partial bottom chord of the left and right heel sections; and a center web section having two segments telescopically slidably joinable to each other, the center web section being pivotally connected at one end to the peak section and pivotally connected at the other end to the center bottom chord section peak.

6. A collapsible metal truss as defined in claim 6 wherein the chord sections are U-shaped in cross-section and the web sections are H-shaped in cross-section.

7. A collapsible metal truss as defined in claim 6 wherein the peak section further comprises a partial vertical center web leg.

* * * * *